United States Patent [19]

Milberger et al.

[11] 4,317,490

[45] Mar. 2, 1982

[54] APPARATUS AND METHOD FOR OBTAINING A CORE AT IN SITU PRESSURE

[75] Inventors: Lionel J. Milberger, Spring; Eddie W. Denk, Bryan; Kai R. Hostrup, Garland, all of Tex.

[73] Assignee: Texas A & M University System, College Station, Tex.

[21] Appl. No.: 128,104

[22] Filed: Mar. 7, 1980

[51] Int. Cl.[3] ..... E21B 25/04; E21B 25/18; E21B 49/00

[52] U.S. Cl. ..... 175/20; 175/59; 175/233; 175/234; 175/236

[58] Field of Search ..... 175/233, 236, 239, 234, 175/246, 247, 248, 58, 20, 59, 94; 166/264; 73/421 R, 421 B, 422 TC

[56] References Cited

U.S. PATENT DOCUMENTS

| | | | |
|---|---|---|---|
| 2,256,552 | 9/1941 | Drake | 175/234 |
| 2,326,435 | 8/1943 | Bynum | 175/236 |
| 2,364,088 | 12/1944 | Miller et al. | 175/233 |
| 2,541,785 | 2/1951 | Smith | 175/233 |
| 2,740,477 | 4/1956 | Monaghan | 175/233 X |
| 3,095,051 | 6/1963 | Robinsky et al. | 175/236 X |
| 3,139,147 | 6/1964 | Hays et al. | 175/233 |
| 3,930,413 | 1/1976 | Laird et al. | 73/421 B |

*Primary Examiner*—Stephen J. Novosad
*Attorney, Agent, or Firm*—Vaden, Eickenroht, Thompson, Bednar & Jamison

[57] ABSTRACT

A method and apparatus are disclosed for obtaining a core at in situ pressure of sedimentary deposits at the bottom of a well bore or body of water. The core barrel has a pressure chamber that is closed and opened by a ball valve actuated from the surface. When in position above the sedimentary deposits to be cored, a sample tube is extended from the pressure chamber into the sedimentary deposits to obtain a core. The sample tube is retracted into the pressure chamber and the valve closed to trap ambient pressure in the chamber. The sample tube and valve are operated from the surface.

19 Claims, 30 Drawing Figures

FIG. 2A
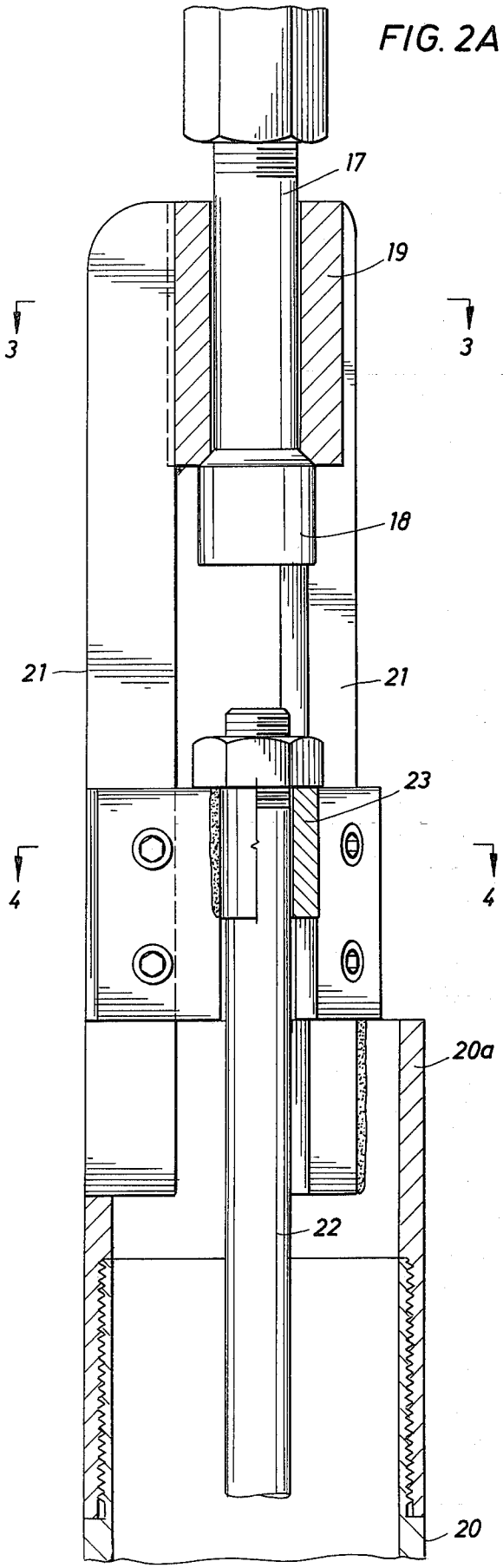
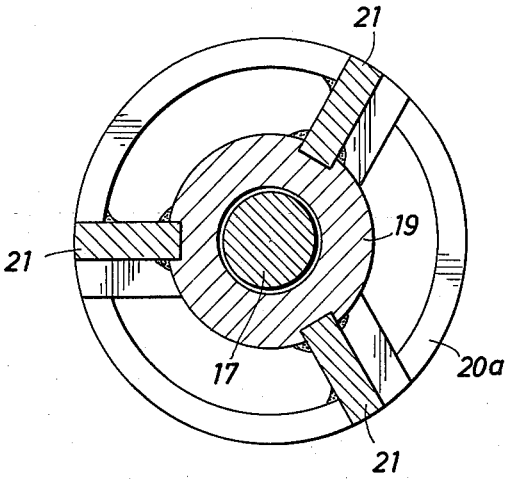
FIG. 3
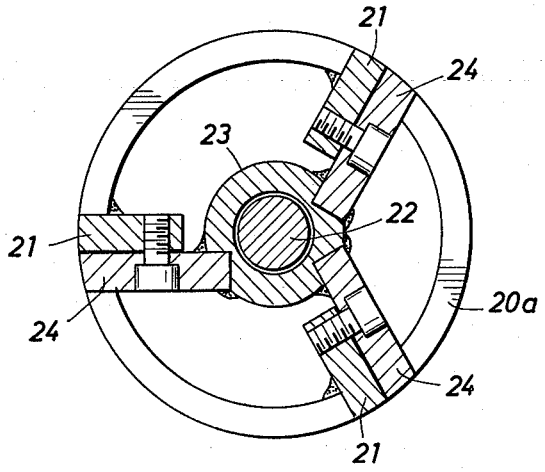
FIG. 4

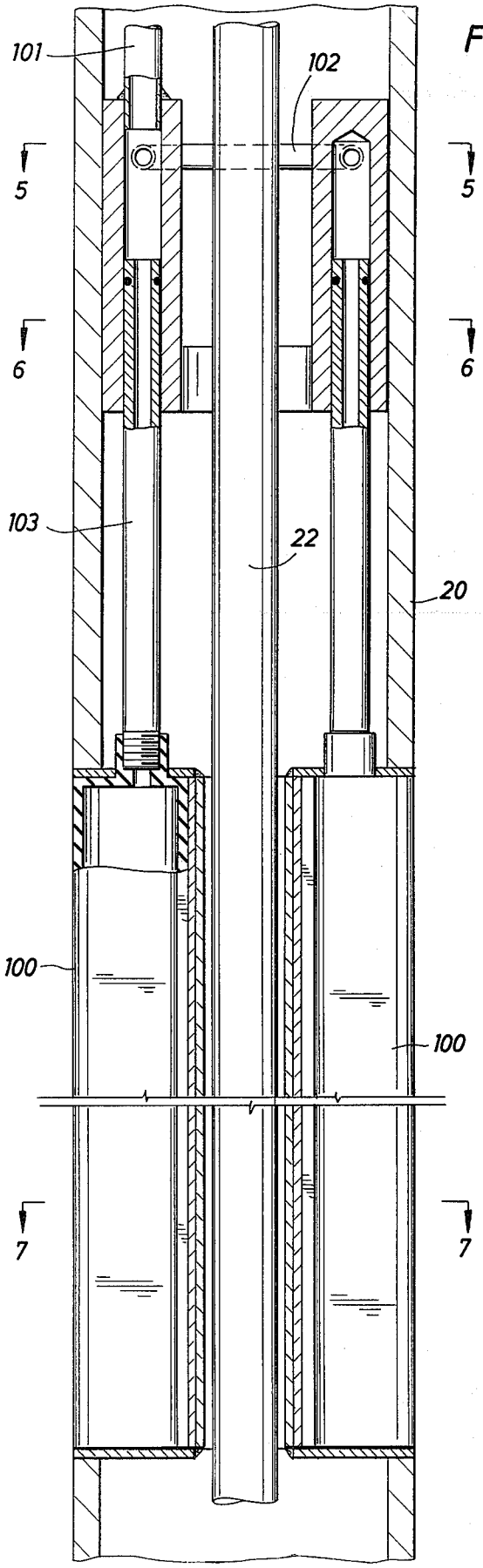
FIG. 2B
FIG. 5
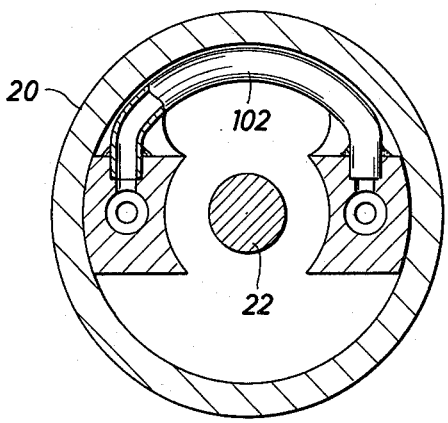
FIG. 6
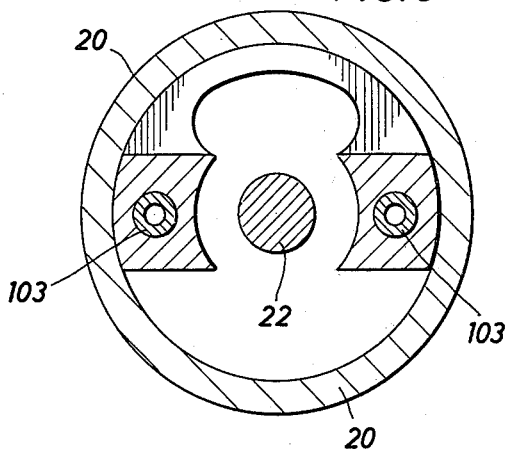
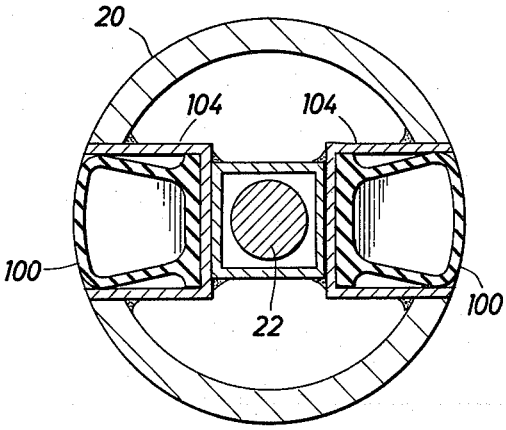
FIG. 7

FIG. 2E
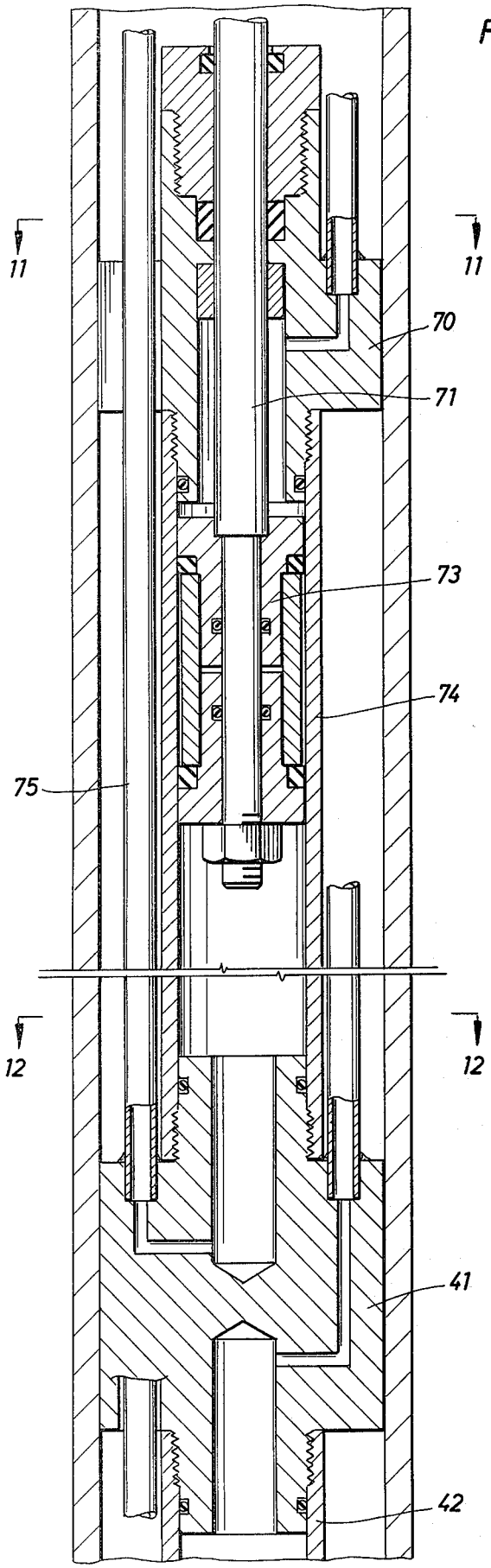
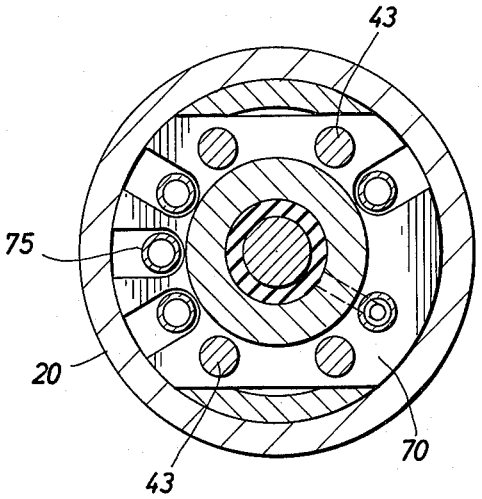
FIG. 11
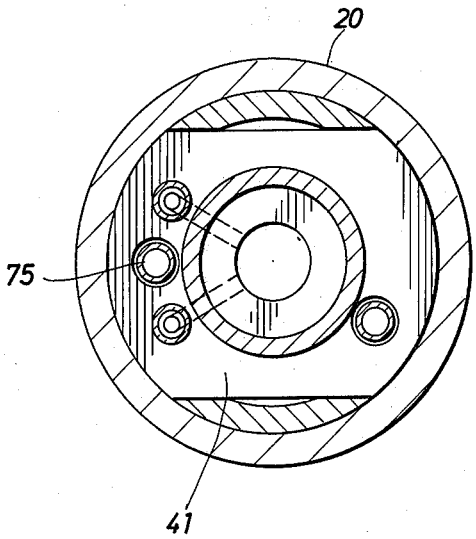
FIG. 12

FIG. 2F
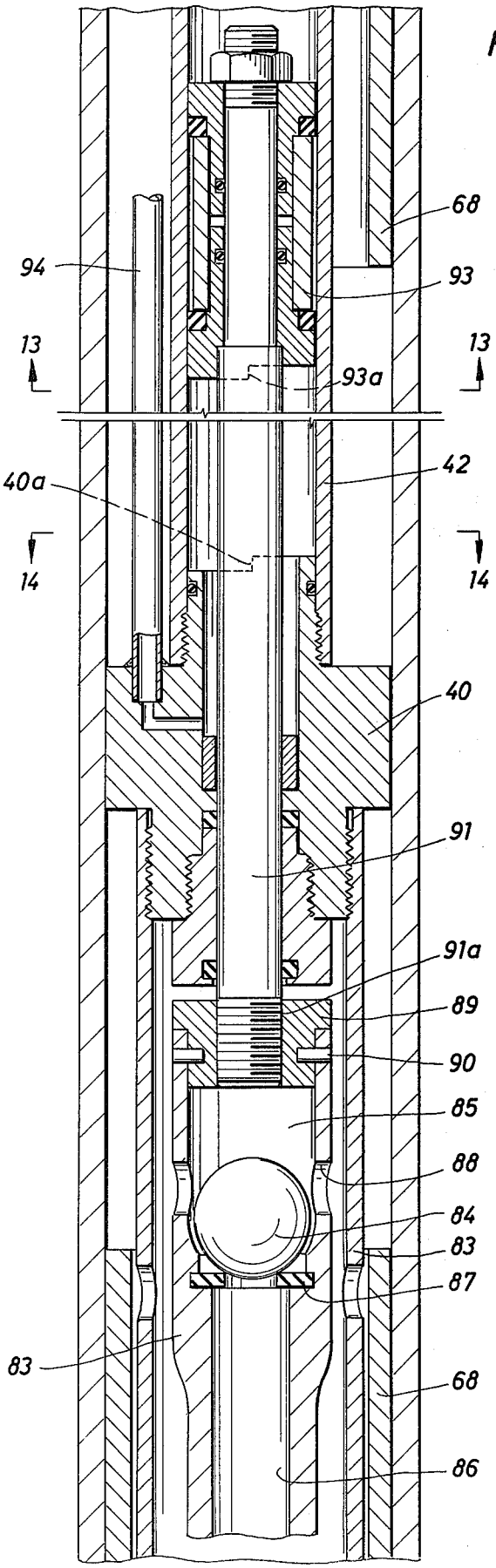
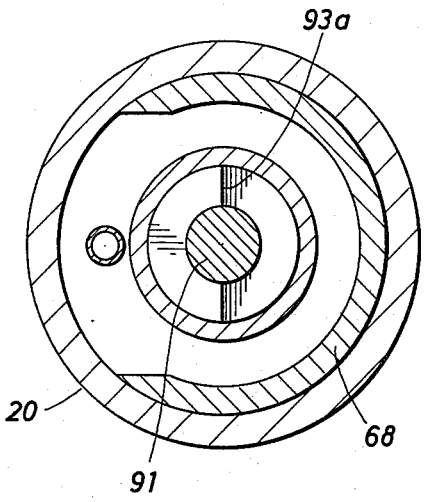
FIG. 13
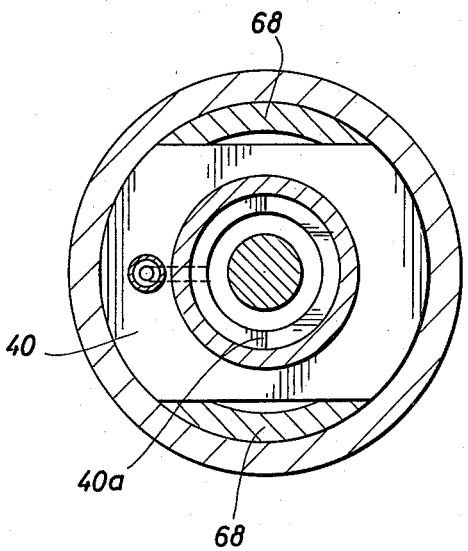
FIG. 14

APPARATUS AND METHOD FOR OBTAINING A CORE AT IN SITU PRESSURE

The government has rights in this invention pursuant to Contract No. 14-08-0001-15605 awarded by the U.S. Geological Survey.

This invention relates to geological coring in general and, in particular, to an apparatus and method for obtaining such cores and for maintaining the cores at their in situ pressure.

Apparatus for cutting cores from subsurface earth formations are generically referred to as "core barrels". This name usually encompasses the entire apparatus including the tube in which the core is held after it has been cut from the subsurface formation. In a conventional core barrel, the drill bit, or core bit, has a hole in the middle of it so that as the bit progresses through the formation the central portion, or core, will move upwardly through the bit into the core barrel which is located immediately above the bit in the drill string. At the end of the coring operation, the core is broken off from the formation. It travels to the surface in the core barrel from which it is removed at the surface.

Various "pressurized" core barrels have been provided. These are generally conventional core barrels of the type just described with an additional valve to close the lower end of the core barrel and trap the core at in situ pressure at the end of the coring operations.

The core barrels described above are designed to obtain cores of relatively highly consolidated material, such as limestone, sandstone and the like found relatively deep below the earth's surface. Obtaining such cores and maintaining the cores at their in situ pressure is important. It is an important aid to geologists and soils engineers, who are studying these formations for the possible production of oil, gas, coal and the like and to determine bearing strength.

There are other subsurface formations presently being investigated, where it is important to obtain samples or cores of the formations at their in situ pressure, but where the above-described coring apparatus cannot be used. These subsurface formations consist primarily of sedimentary deposits located near the surface of the earth. These deposits usually consist of unconsolidated clays, sand, and silt. They are usually 100% saturated with water except for what methane gas may be present. In fact, it is the presence of this methane gas that has made it very important that samples, or cores, of these sediments be recovered at their in situ pressure. Otherwise, such samples, if they do contain methane gas will "grow" and take on a frothy texture as the samples are raised to the surface due to the expansion and escape of the methane gas as the ambient pressure on the core decreases to atmospheric pressure. As a result, the sample obtained has little relationship to the condition of the sample in the formation from where it was taken and does not provide the information required regarding the conditions of the formation at the depth of the sample.

It is an object of this invention to provide apparatus for and a method of obtaining a core, or sample, of relatively unconsolidated sedimentary deposits and maintaining the core or sample at its in situ pressure as it is moved to the surface and to a location where it can be tested.

One of the reasons that the conventional coring apparatus described above cannot be used to obtain cores, or samples, of such unconsolidated material is that in the coring operation drilling mud is circulated down through the drill string, out the bottom of the coring bit and back up the annulus between the drill string and the well bore. Such an operation in the relatively unconsolidated formations near the surface of the earth would result in the material coming through the middle of the core bit simply being washed away and carried to the surface and little or no material would be moved into the sample tube of the core barrel. Further, what material did move into the sample tube would be badly contaminated by the drilling fluid.

Therefore, it is another object of this invention to provide apparatus for and a method of obtaining a sample at its in situ pressure that obtains a sample from the formation below the bottom of the well bore to reduce contamination of the core by the drilling fluid in the well bore.

It is a further object of this invention to provide apparatus for obtaining a sample, or core, from the bottom of a well bore at its in situ pressure that can be lowered on a wire line through the drill string operated from the surface and removed from the drill string without having to pull the drill string from the well bore.

This is a particularly advantageous feature of the invention because in the usual sampling operation of these near surface sedimentary deposits, a well bore will be drilled but no casing will be set as in the conventional deeper drilling operations. Thus by using the apparatus of this invention, when the well bore reaches a certain depth, a sample can be taken, drilling can be resumed and this procedure repeated at various depths without having to pull the drill pipe and the core bit out of the well bore. This is particularly important when coring below a relatively deep body of water, where it is often difficult to reenter the well bore again after the drill pipe has been removed from it.

The preferred valve for closing the lower end of the sample tube after the core has been obtained is what is called a "ball" valve. This is a well-known valve structure having a ball-shaped valve member that rests on an annular seat in the valve body. The ball has a hole through it which can be rotated to a position in-line with the longitudinal axis of the sample tube and provide a full sized opening through which the core can pass. To close the valve, it is necessary to rotate the ball valve member only 90°.

Usually, the ball of a ball valve is supported for rotation by trunions. Using trunions, however, increases the outside diameter of the valve housing required for a given valve opening. Conversely, for a given outside diameter the use of trunions decrease the size of the opening through the valve that can be used.

Therefore, it is another object of this invention to provide a core barrel with a ball valve having a ball that is not supported by trunions, in which the ball is held in sealing engagement with the valve seat by loading members located above the ball that rest on the ball and by their weight exert a downward force on the ball and in which load imposed by the members is removed from the ball and the ball moved upwardly out of contact with its seat when the ball is rotated from its open to its closed position to thereby substantially reduce the torque required to rotate the ball and to also reduce the chances of cutting the valve seat due to abrasive material being present in the fluid around the ball.

These and other objects, advantages and features of the invention will be apparent to those skilled in the art from a consideration of this specification, including the attached drawings and appended claims.

In the drawings wherein like reference characters are used throughout to designate like parts:

FIGS. 2A–2G are vertical sectional views through the preferred embodiment of the apparatus of this invention;

FIGS. 3 through 15 are cross-sectional views of the apparatus shown in FIGS. 2A–2G taken along the corresponding lines indicated in FIGS. 2A–2G;

Figure 1:
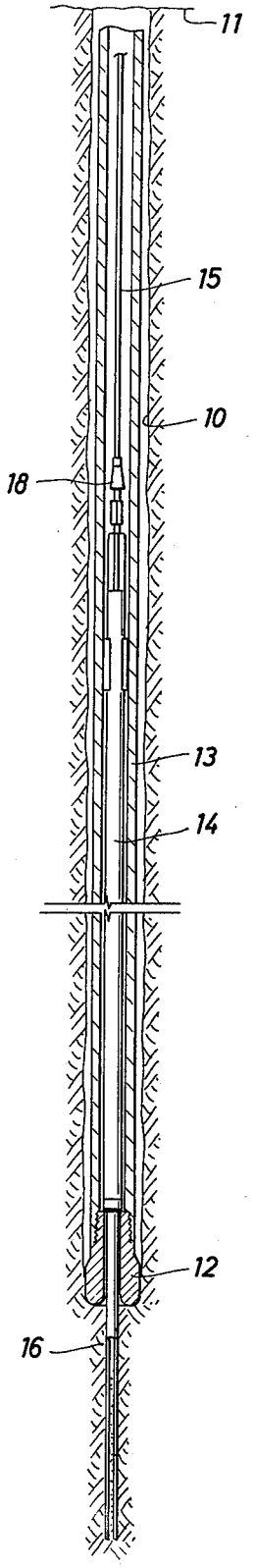
FIG. 1 is a vertical sectional view through a well bore and the drill string in the well bore with the coring apparatus of this invention in position in the drill string and taking a core or sample of the formation below the bottom of the well bore.

As explained above, the apparatus and method of this invention is particularly useful in obtaining cores of relatively unconsolidated sedimentary deposits of the type located near the earth's surface. In FIG. 1, the apparatus of this invention is shown in the process of obtaining such a sample. Well bore 10 has been drilled below surface 11 to the desired depth by core bit 12 attached to the lower end of drill string 13. Surface 11 is what is commonly called the "mud line", if the sampling operation is being conducted below a body of water. After the well bore has been drilled to the desired depth, drilling operations are stopped and the apparatus of this invention, i.e., core barrel 14, is lowered through the drill pipe on wire line 15. When the core barrel reaches the bottom of the drill pipe, the core barrel is anchored to the inside of the drill pipe and sample or core tube 16 is forced through the opening in the core bit into the sedimentary deposits below the bottom of the well bore, as shown in FIG. 1.

In FIGS. 2 through 15, the preferred embodiment of the structure of the apparatus of this invention is shown. The apparatus is run into and out of the well bore through the drill pipe on wire line 15. The wire line is connected to the upper end of bolt 17 by conventional wire line socket 18, shown in FIG. 1. Bolt 17 has enlarged head 18 that engages the beveled lower end of bushing 19 to support the core barrel. This allows the core barrel and the wire line to rotate relative to each other. Bushing 19 supports housing 20 of the core barrel through support members 21 which are welded at one end to the inside of upper end cap 20*a* of housing 20. The other ends of the members are welded to bushing 19.

Most everything inside housing 20 of the core barrel is suspended from upper support rod 22 which extends downwardly through the upper end of housing 20. The load on the support rod is transferred to housing 20 or wire line 15, depending upon which one is carrying the load, by bushing 23 and support plates 24 which are bolted to support members 21.

In accordance with the preferred embodiment of this invention, the core barrel includes:

1. Means for moving a sample tube out the bottom of the core barrel and into the sedimentary deposits at the bottom of a well bore to obtain a sample of these deposits and for moving the sample tube back into a pressure chamber located in the core barrel;

2. Means for relieving the ball valve member of the ball valve used to close the lower end of the pressure chamber of most of the downward forces tending to hold the ball valve member against its lower seat; and 3. Means for moving the ball valve member upwardly away from its lower seat before it is rotated to the closed position to avoid damage to the lower seat and also to reduce substantially the turning moment required to rotate the ball valve member.

The core barrel includes pressure chamber 28 located at the lower end of housing 20. Valve means are provided to close the lower end of the pressure chamber. In the embodiment shown, the valve means includes ball valve member 30 having opening 31 extending therethrough. The valve is opened and closed by rotating the ball valve member 90° around an axis perpendicular to the longitudinal axis of opening 31. The valve is shown in the closed position in FIG. 2G with opening 31 extending transverse the longitudinal axis of housing 20 and pressure chamber 28. The valve is shown in the open position in FIG. 16D, where opening 31 has been moved into axial alignment with pressure chamber 28. The ball valve member is sometimes referred to hereafter as "the ball" or "ball 30".

The valve includes lower valve seat 32 and upper valve seat 33. The lower valve seat in an annular member of resilient material that engages the spherical outer surface of ball member 30. It is molded in the upper end of valve seat holding member 34, which is connected to the lower end of housing 20. Upper valve seat 33 is also an annular body of resilient material that engages the cylindrical outer surface of the ball of the valve. It is not intended nor designed, however, to provide a seal between the ball and the valve seat but as will be described below serves to assist in rotating the ball to its closed position. Upper seat 33 is attached to upper seat support member 35 by pins 36.

As explained above, means are provided to relieve the ball valve member of most of the weight of the apparatus above the ball that urge it into engagement with lower seat 32 when the ball is to be moved from its open to closed position. In the embodiments shown, this means includes tubular member 38 the lower end of which normally rests on shoulder 39 in upper valve seat support member 35. The upper end of tubular member 38 is connected to lower cylinder head 40. Cylinder head 40 in turn is connected to intermediate cylinder head 41 by tubular member 42. Intermediate cylinder head 41 is supported by and connected for movement with cross head 44 by four tie rods 43, as shown in FIG. 2D.

Figure 2C:
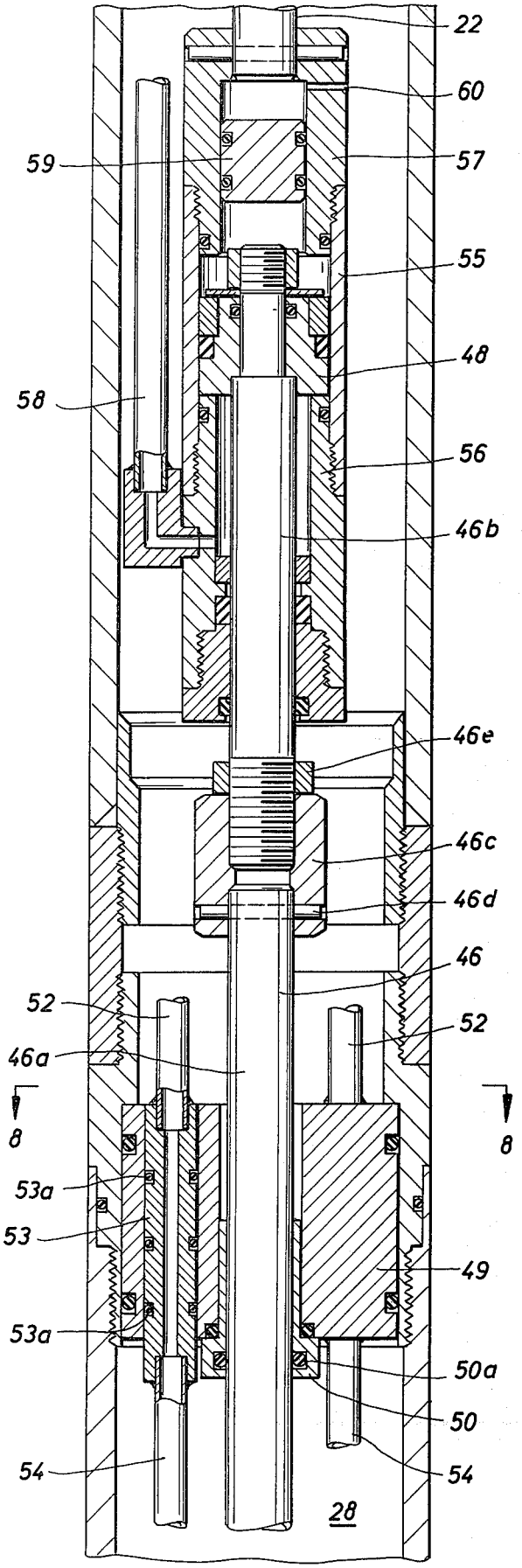
Figure 2D:
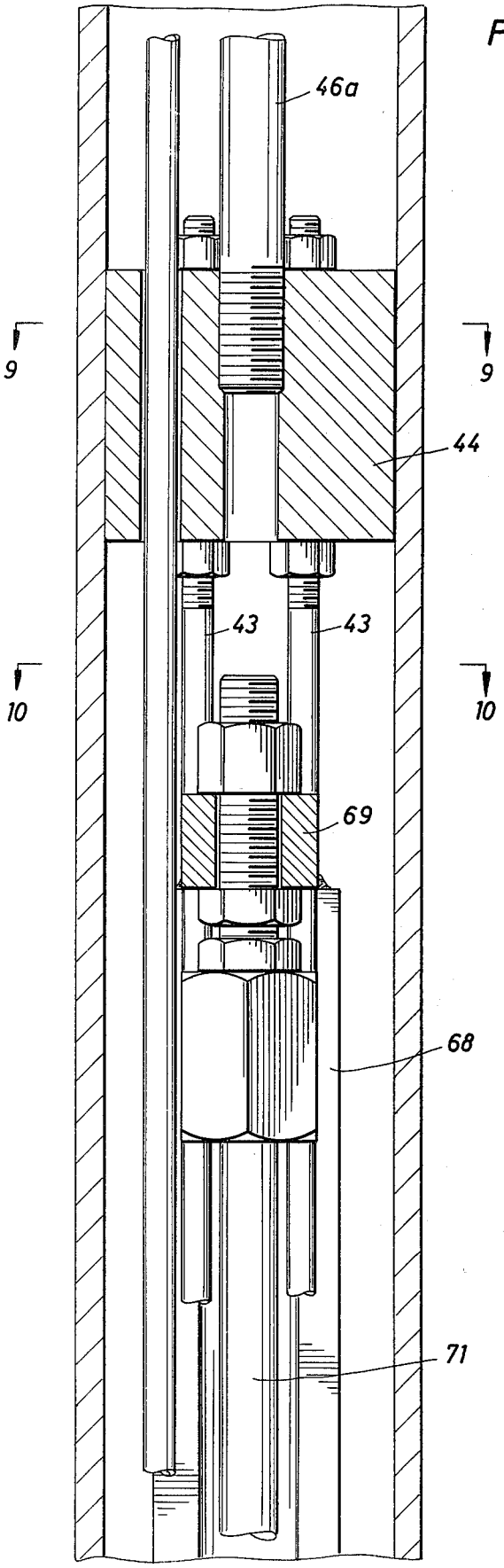
Figure 9:
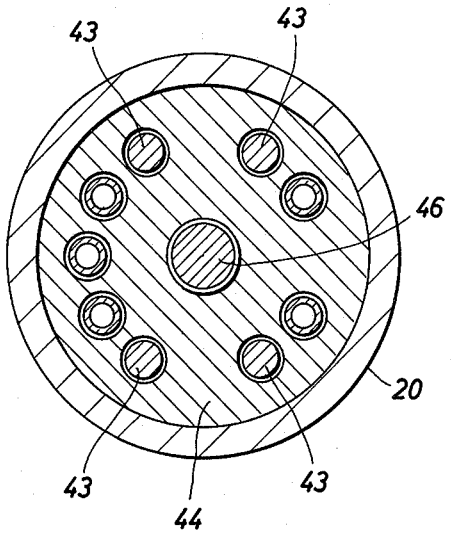

Piston rod assembly 46 connects cross head 44 with piston 48, as shown in FIG. 2C. Piston 48 is referred to as the ball unloading piston. Its function is to raise all of the apparatus described above that is connected to rod 46 to relieve the ball of any of the weight of this apparatus prior to its being rotated to the closed position. Unloading rod 46 includes a lower polished rod section 46*a* and upper piston rod section 46*b*. The two sections are connected together through crossover nut 46*c* which is connected to polished rod section 46*a* by pin 46*d*. A threaded connection is provided between the nut and piston rod section 46*b*, which along with jam nut 46*e* allows the overall length of the piston rod to be adjusted.

Figure 8:
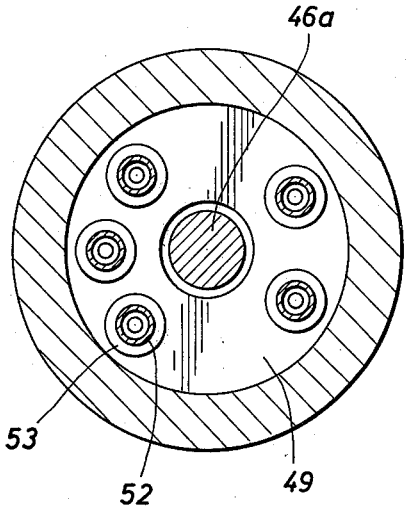

Section 46*a* of the unloading rod passes through a central opening in upper seal assembly 49. O-ring 50*a* carried by bushing 50 provides a moving seal between the upper seal assembly and section 46*a* of the unloading rod. The upper seal assembly also serves to seal the upper end of pressure chamber 28. As shown in FIG. 8, in addition to the unloading rod, five hydraulic lines are connected together through the upper seal assembly. These lines are conduits for the hydraulic fluid used to operate the two hydraulic cylinder assemblies located below the upper seal assembly in the pressure chamber. The lines 52 extend from the surface and pass downwardly through housing 20. Each line is connected to one of five tubular conduits 53 extending through the body of the upper seal assembly. Hydraulic lines 54 are connected to the lower end of tubular conduits 53. Four are used to carry hydraulic fluid to the hydraulic cylinder assemblies located below. One acts as a pressure-monitoring line and can also be used as a purge line. Tubular conduits 53 can slide axially relative to the upper seal assembly to accomodate some movement of the lines. By using several spaced seals 53*a* substantial axial movement can be accommodated. A threaded connection is provided at this location in the housing to allow the housing to be broken apart to gain access to the upper seal assembly and also to the adjustable connection between the upper and lower sections of unloading rod 46.

Unloading piston 48 is located in cylinder 55. The downward travel of piston 48 is limited by cylinder head 56. The upper extent of its travel is limited by upper cylinder head 57. This is a single acting hydraulic cylinder. The actuating fluid is introduced through hydraulic line 58 through ports provided in cylinder head 56 to apply pressure against the underside of piston 48 and move it upwardly relative to cylinder 55.

To allow for the displacement of fluid above piston 48 as it moves upwardly in the cylinder, pressure equalizing piston 59 is located in upper cylinder head 57. Port 60 allows the free flow of fluid into and out of the space above piston 59 as required by the movement of unloading piston 48.

Figure 16A:
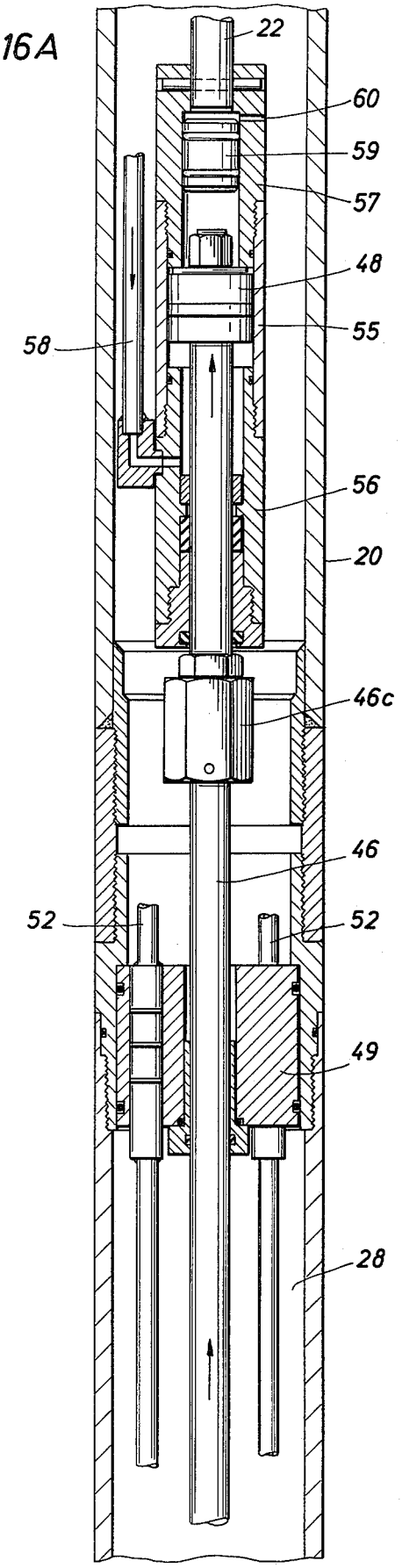
FIGS. 16A–16D are sectional views on a reduced scale of the portion of the apparatus shown in FIG. 2 that contain the hydraulic cylinders used to operate the apparatus during the coring operation.
Figure 16B:
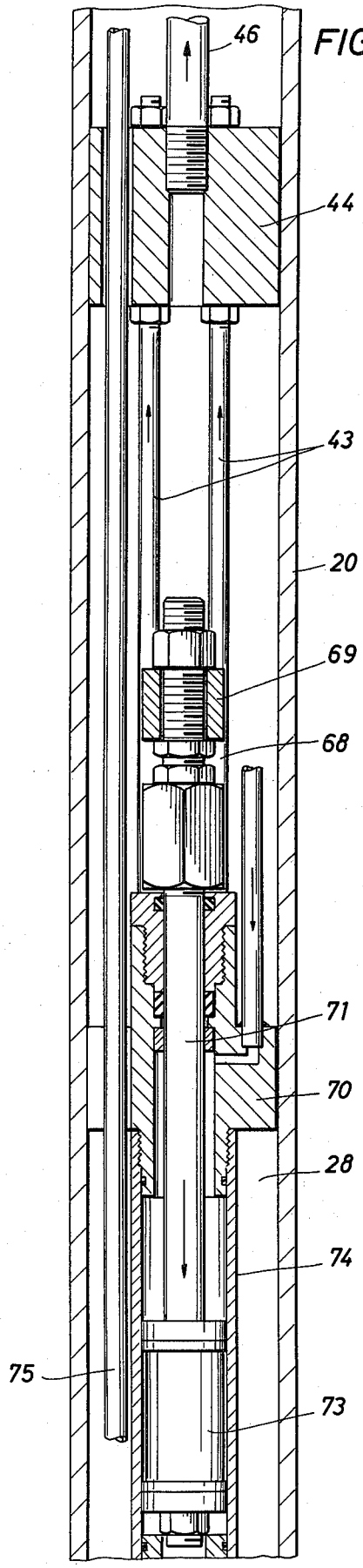
Figure 16C:
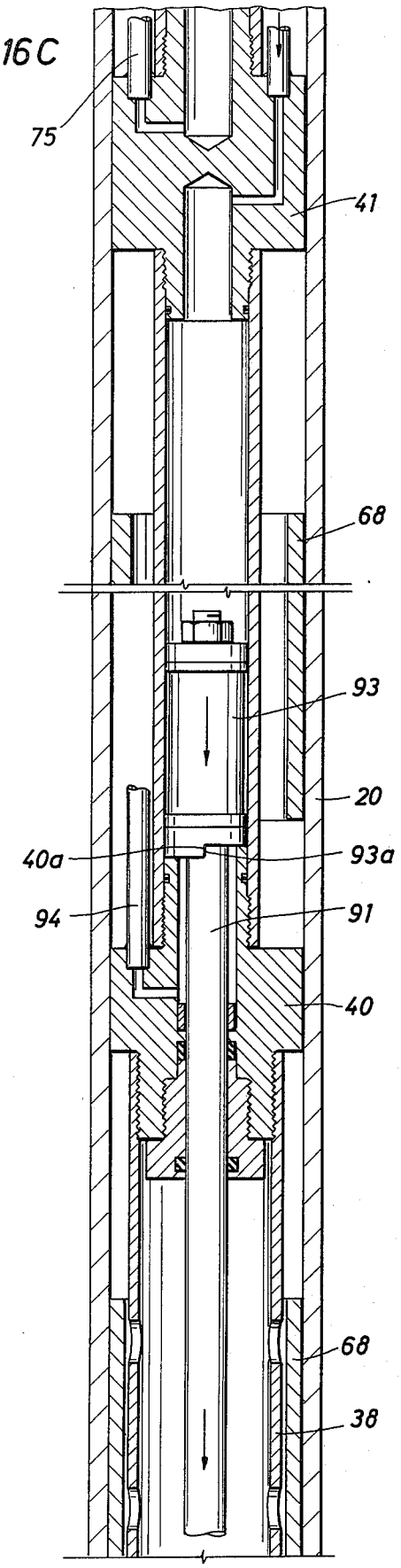
Figure 16D:
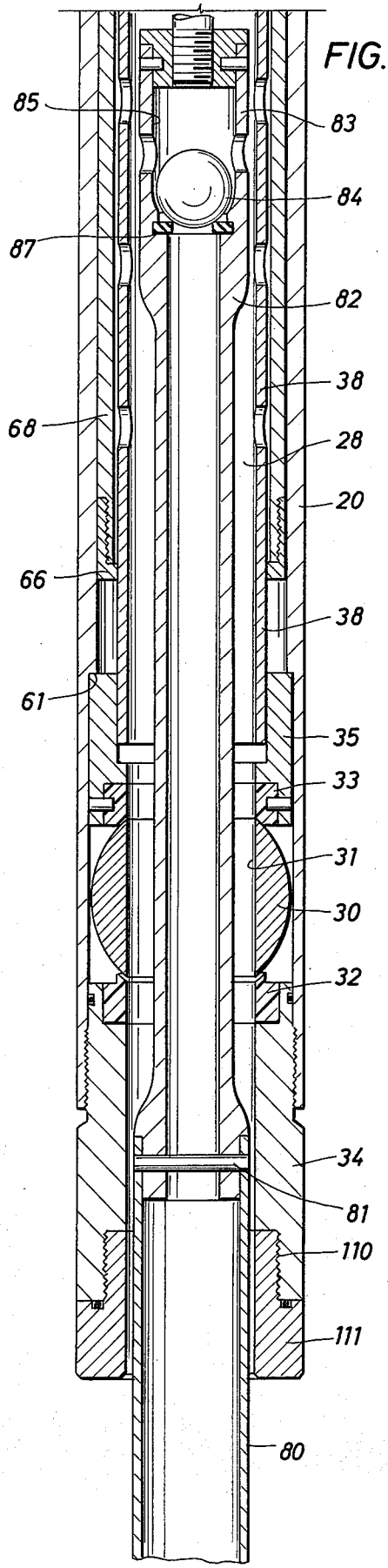

By applying fluid pressure below piston 48, upper valve seat retaining member 35 and upper valve seat 33 are moved upwardly until the upper seat retaining member 35 engages shoulder 61 on housing 20, as shown in FIG. 16D.

Figure 2G:
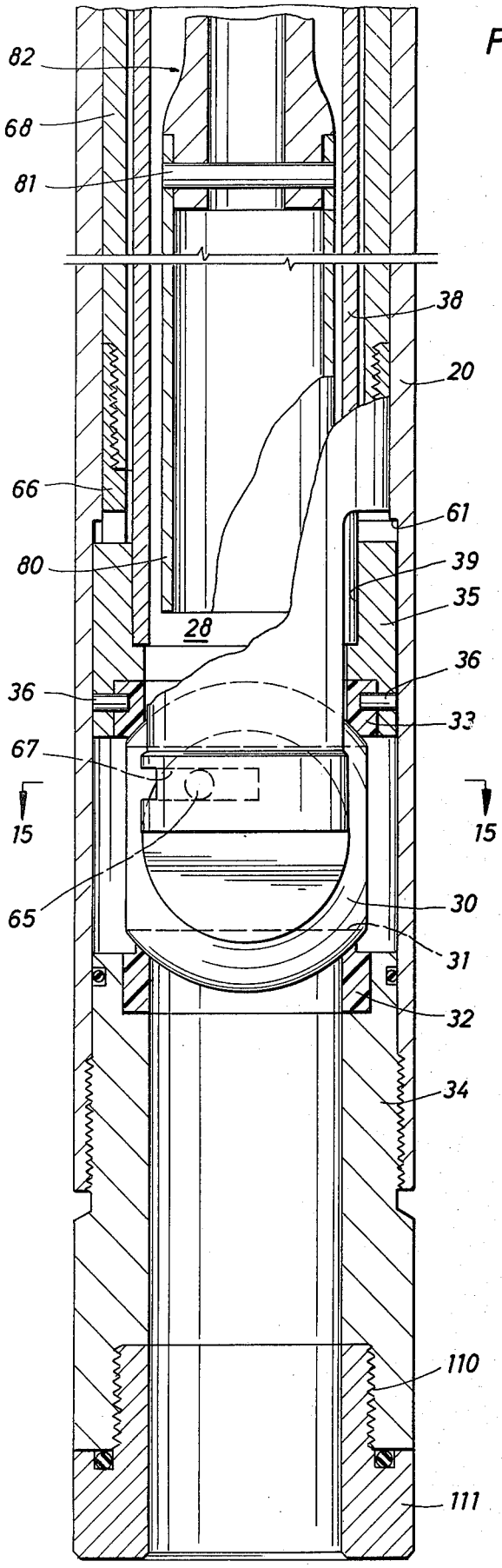
Figure 15:
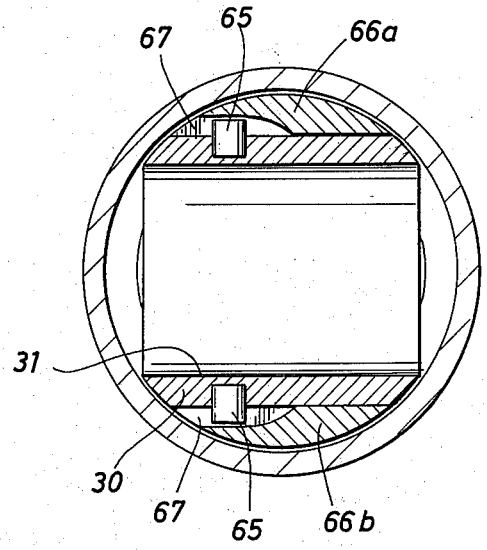

Means are provided to move the ball valve member between its open and closed position. In FIG. 2G the valve is shown with the ball in its closed position. Actuating pins 65 are attached to opposite sides of the ball and spaced from the axis of rotation of the ball. The pins are located relative to opening 31 in the ball so that when the valve is in the closed position, as shown in FIG. 2G, pins 65 will be in a position along a line approximately 45° above the horizontal. When the valve is closed, pins 65 will occupy a position directly below the position shown in FIG. 2G but on a line 45° below the horizontal. Thus, to move the valve from its open to its closed position, pins 65 must be moved upwardly a distance sufficient to move the ball through an angle of about 90°.

Figure 10:
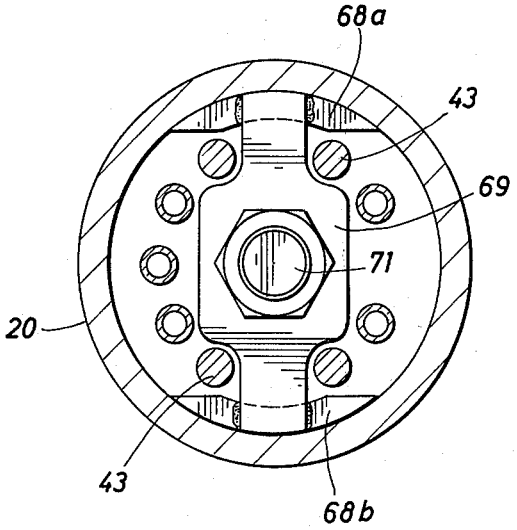

To rotate the ball, valve actuator 66 has arms 66*a* and 66*b* that extend downwardly along opposite sides of the ball. Each arm has horizontal slot 67 in which one of pins 65 is located. The upper end of valve actuator 66 is connected to valve turning tube 68. The turning tube extends upwardly through the pressure chamber along the inner well of housing 20 to where the tube is attached to yoke 69, as shown in FIGS. 2D and 10. Along the way the sides of the tube are milled away as required for the tube to pass alongside cylinder head 70, as shown in FIG. 11, cylinder head 41, as shown in FIG. 12, and cylinder head 40, as shown in FIG. 14.

Referring again to FIG. 2D, yoke 69 is attached to the upper end of valve actuating rod 71, which extends downwardly through cylinder head 70 and is connected to piston 73. The piston is located in cylinder 74 which is connected between cylinder head 70 and cylinder head 41. Hydraulic pressure through line 75 will move piston 73 upwardly carrying yoke 69 and turning tube 68 along with it. This in turn will cause valve actuating member 66 to move pins 65 on the ball upwardly to the position shown in FIG. 2G and close the valve.

Since the ball valve member is not mounted on trunions, there would not necessarily be any relationship between the upward movement of pin 65 and the rotation of the ball. Upper seat 33 and upper valve support member rest on the ball. They are moved upwardly to the position shown in FIG. 16D into engagement with shoulder 61 on housing 20 when the valve operating mechanism is actuated to move ball valve member 30 upwardly away from lower seat 32. When the upper valve support member engages shoulder 61, upper valve seat 33 can no longer move upwardly and valve operating member 66 through its arms 66*a* and 66*b* by continuing to exert upward movement on pins 65 will cause the ball to rotate to the closed position. The rotation of the ball occurs out of contact with lower valve seat 32. This arrangement, as explained above, reduces the force required to turn the ball 90° since the only force resisting this turning moment is the frictional force exerted by upper seat 33 against the outside surface of the ball. The weight of the ball actually helps by increasing the turning moment between the center of gravity of the ball and the upward forces on pins 65.

In the operation of the core barrel, a sample or core tube is moved down through the end of the core barrel into the sedimentary deposits located at the bottom of a bore hole to obtain a sample thereof by forcing these deposits upwardly into the sample tube. The sample tube is then retracted back into the core barrel into the pressure chamber provided therefor in the bottom section of the core barrel and the valve means provided is closed to seal the sample tube in the pressure chamber at in situ pressure. In the embodiment shown, sample tube 80 which is a relatively thin-walled tubular member, is connected by pin 81 to the lower end of check valve assembly 82. The check valve assembly includes check valve body 83 and ball 84 which is located in bore 85 at the upper end of body 83. Bore 86 extending below bore 85 is a smaller diameter to provide a shoulder to support check valve seat 87. Ports are provided in the wall of bore 85 to allow fluid to flow into and out of chamber 85. Fluid flowing into chamber 85 will force ball 84 into sealing engagement with seat 87 and prevent the flow of fluid in that direction. Fluid is free to flow in the other direction upwardly through bore 86 and out through ports 88. This allows the fluid in the sample tube to be displaced through the check valve as the core moves upwardly into the sample tube.

The upper end of chamber 85 is closed by plug 89 which is attached to the body of the check valve by pins 90. Piston rod 91 has one end connected to plug 89 by threads 91*a* to support the check valve assembly and the sample tube. Threads 91*a* are left hand for reasons described below. The other end of rod 91 extends through and is connected to piston 93. As with the other pistons, the specific structure of piston 93 will not be described in detail since any convenient arrangement can be used and the particular structure preferred is clearly shown in the drawings. All of the pistons, of course, are provided with seals that engage the side walls of the cylinders in which they are located in the conventional manner.

Piston 93 is located in cylinder 42 that extends between cylinder head 40 and cylinder head 41. Pressure supplied to the cylinder above the piston through cylinder head 41 will move rod 91 downwardly along with check valve assembly 83 in the sample tube. The stroke of cylinder 42 will inherently be substantially longer than the previous cylinders described since it must move the sample tube through the ball valve out the end of the core barrel through the core bit on the bottom of the drill string and far enough into the sedimentary deposits at the bottom of the bore hole to obtain a good representative sample thereof. FIG. 16D shows the tube extended into the ground below the core bit although the core bit and drill string are not shown.

After the sample tube has been extended to obtain a sample, pressure is applied against the bottom of piston 93 through hydraulic line 94 and the sample tube retracted upwardly into the pressure chamber of the core barrel above the ball valve. At this time, the unloading piston is actuated to lift upper seat 33 upwardly away from ball 30 of the valve. This same upward movement is imparted to cylinder 42. Since fluid pressure continues to be applied under piston 93, the sample tube and check valve 70 will move upwardly with cylinder 42 and remain positioned above ball 30.

After the upper seat has been moved upwardly from the ball, valve actuating piston 73 is actuated to close the valve. The pressure in all cylinders can now be released. The weight of most of the structure above the ball will now be supported by the ball forcing the ball into good sealing engagement with the lower seal and the core barrel can be removed from the well bore to the surface and in situ pressure will be maintained in the pressure chamber.

As the sample tube is forced into the ground at the bottom of a well bore the resistance to penetration of the tube may be such that it will overcome the downward force of the weight of the core barrel. If this happens the core barrel will move up and the sample tube will stand still. To avoid this possibility, means are provided to anchor the core barrel in the drill string against relative vertical movement. In the embodiment shown, two inflatable bladders 100 are mounted on opposite sides of housing 20, as shown in FIGS. 2B and 5–7. The bladders are elongated tubes of elastomeric material arranged, as shown in FIG. 7, to expand outwardly when inflated to engage the inside of the drill string and provide a frictional force to resist upward movement of the core barrel relative to the drill string. Hydraulic pressure, or pneumatic pressure if desired, is supplied uniformly to both bladders through conduits 101, 102 and 103. The bladders are held against any movement except outwardly from housing 20 by U-shaped mounting brackets 104.

When the core barrel reaches the surface, means are provided for removing the sample tube and core from the pressure chamber of the core barrel and for transferring the sample tube and core to a transfer tube where the core can be held at in situ pressure until such time as it can be examined and tested.

Figure 17:
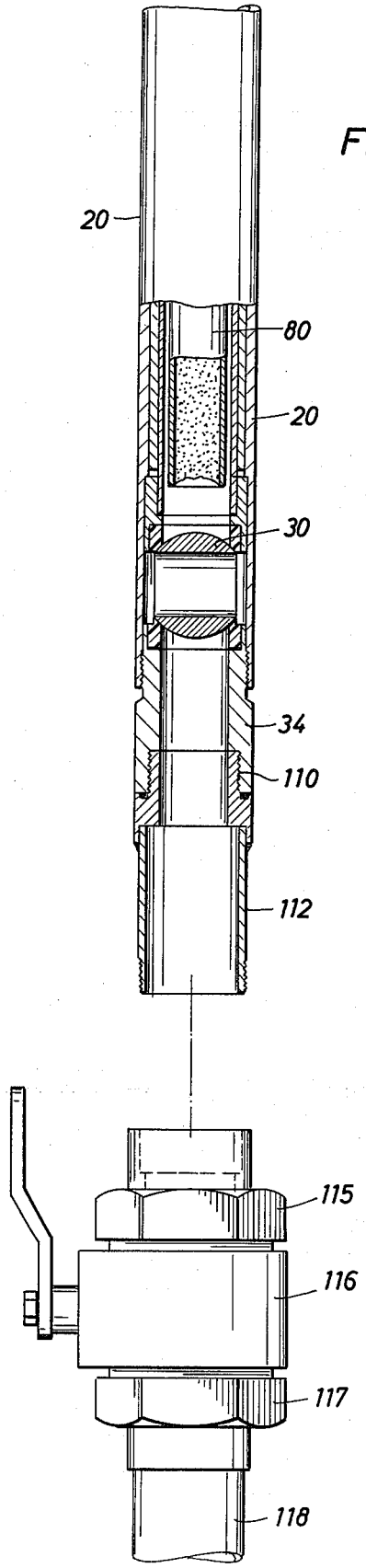
FIG. 17 is a view partly in section and partly in elevation with the lower end of the coring apparatus in position to be connected to the end of the transfer tube which is used to maintain the core at in situ pressure after it is removed from the core barrel.

Lower valve seat mounting member 34 extends below the end of housing 20 of the core barrel and is provided with internal threads 110. When the core barrel is in operation, these threads are protected by threaded plug 111. After the core has been cut and the core barrel retrieved to the surface, thread protecting plug 111 is removed and adapter tube 112 is connected to threads 110 at the lower end of the core barrel, as shown in FIG. 17. Transfer tube 114 is then connected to adapter tube 112 in any convenient manner such as by union 115.

Figure 18A:
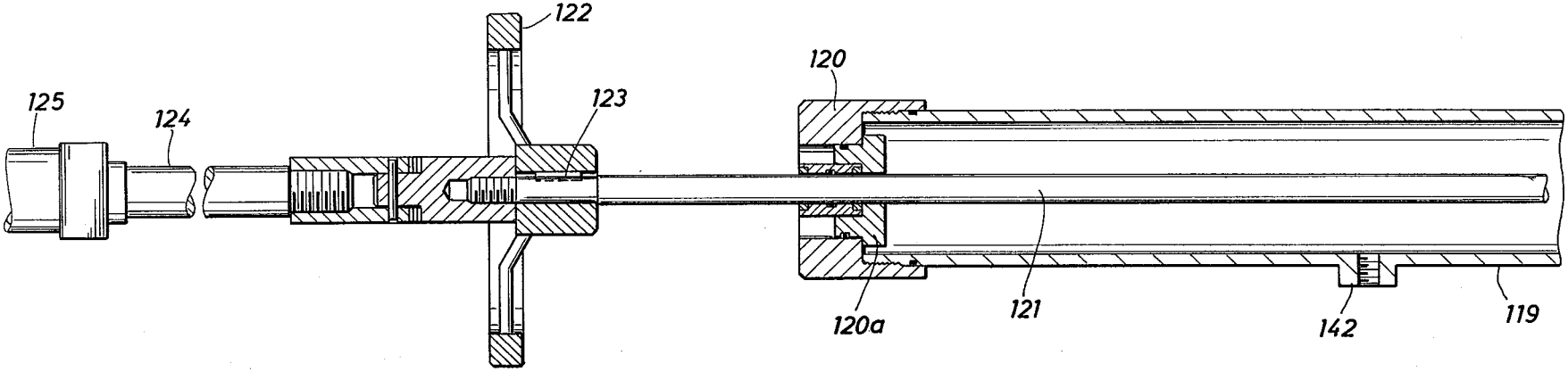
FIGS. 18A and 18B are sectional views of the transfer tube and the apparatus employed with the transfer tube to move the sample tube of the core barrel from the core barrel into the transfer tube.
Figure 18B:
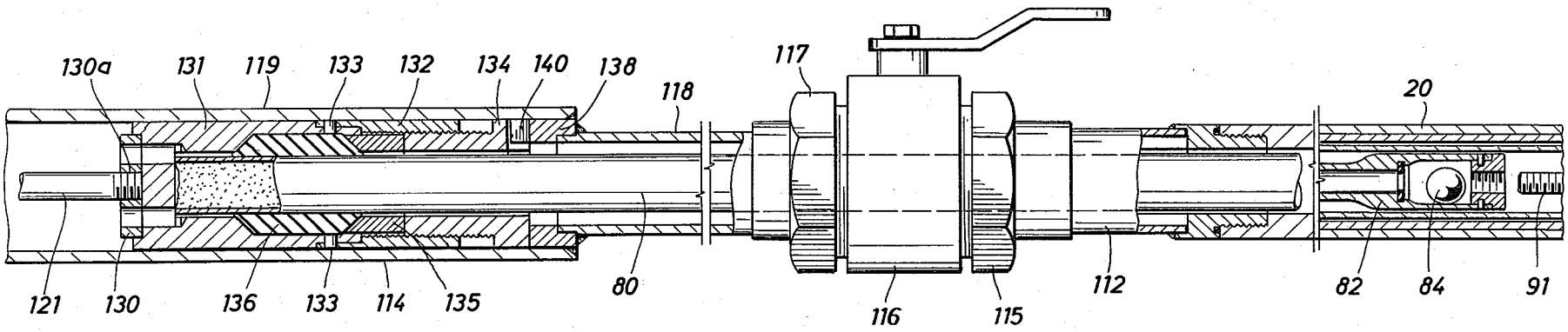
Figure 19A:
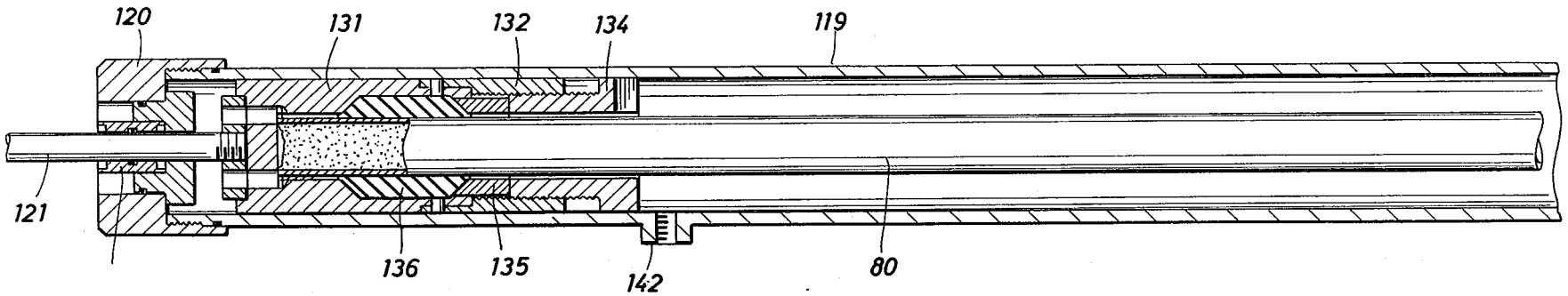
FIGS. 19A and 19B are sectional views of the transfer tube after the sample tube has been completely moved into position in the transfer tube.
Figure 19B:
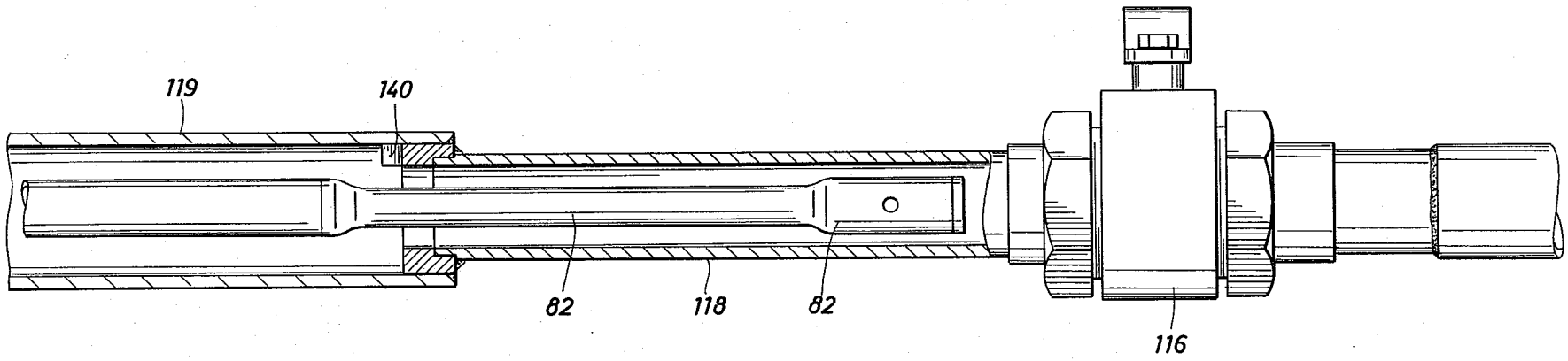

As shown in FIGS. 18 and 19, the transfer tube assembly includes valve 116, which may be any full opening valve but is preferably a ball valve. The valve is hand operated, and is connected in the assembly by unions 115 and 117. Nipple 118 connects the valve to larger diameter housing 119. The other end of the housing is closed by cap 120 having an opening through which rod 121 extends. Stuffing box assembly 120*a* prevents fluid from escaping from the inside of transfer tube housing 119 between the rod and the end cap.

Outside of the transfer tube, the end of the rod is connected to handwheel 122 for rotation of the rod through key 123 located in the hub of the handwheel. The rod extends through the hub and is connected to piston 124 which, in turn, is connected to a piston (not shown) located in cylinder 125. The structure is not shown but it is intended that cylinder 125 will be attached in some convenient manner to the floor or to some structural member that will hold the cylinder from axial movement. The purpose of the cylinder is to help overcome the force exerted by the pressure in the transfer tube acting over the cross-sectional area of rod 121, which tends to force the rod out of the transfer tube.

The other end of rod 121 is connected to the sample tube gripping assembly. The assembly includes drive plate 130 which is connected to the end of rod 121 by threads 130*a*. The plate is connected to packing compression member 131 by bolts, which are not shown. Mating holes in the drive plate and in the packing compression member allow the free flow of fluid therethrough. Compression member 131 is connected to threaded sleeve 132 by pins 133. The threads on sleeve 132 engage threads on the outside of bushing 134 so that relative rotation of the nut and the bushing will cause the two members to move axially relative to each other. Compression ring 135 is located between the end of bushing 134 and annular packing member 136. The packing member is a body of elastomeric material and is shaped with beveled ends to match the cavity provided therefor in compression member 131 and the end of ring 135. Bushing 134 is held against rotation by annular end closure member 138, which is welded to the end of nipple 118 and to the end of tubular housing 119. Member 138 has lug 140 that extends into a groove in the end of the bushing to hold the bushing from rotation relative to nipple 118 and housing 119.

With the transfer tube connected to the end of the core barrel, as described above, the sample tube is moved into the transfer tube as follows: Valve 116 on the transfer tube is opened and the pressure in the transfer tube is raised to the pressure existing in the pressure chamber of the core barrel. Hydraulic cylinder 125 is used to move rod 121 with the sample tube gripping assembly to the position shown in FIG. 18B, which is as far as this assembly can be moved toward the core barrel. The valve on the core barrel is then opened and piston 93 is actuated to move the sample tube through the valve out the end of the core barrel and into the position shown in FIG. 18B with the sample tube extending through annular packing ring 136. At this point the tube is not fully extended from the core barrel. Handwheel 122 is rotated to cause relative rotation between nut 132 and bushing 134 which, in turn, compresses annular member 136 into frictional engagement with the outside surface of the sample tube. Rod 121 is then moved to the left as viewed in FIG. 18B until lug 140 is clear of its engagement with bushing 134 and shoulder 93*a* on piston 93 engages shoulder 40*a* on cylinder head 40, as shown in FIG. 16*c*. Piston rod 91 is now held against rotation. Continued rotation of rod 121 will unscrew left handed threads 91*a* and release the sample tube and check valve assembly from the core barrel.

Rod 121 can now pull the sample tube and the check valve assembly all the way into transfer tube 114. Valve 116 is then closed to maintain the in situ pressure on the core in the transfer tube and the transfer tube can be disconnected from the core barrel for movement of the core to the laboratory for testing.

Grooves (not shown) extend longitudinally along the outside surfaces of the members of the sample tube gripping assembly so fluid can flow freely by the assembly as it is moved in the transfer tube.

The hydraulic lines through which pressure is applied to operate the pistons are usually strapped together in a bundle and are connected to a control console at the surface. Pneumatic pressure could be used, if desired.

One of the five lines connected to upper seal member 49 serves to monitor the pressure in the pressure chamber. It is also used to maintain in situ pressure on the core. In operation, the pressure in the pressure chamber is measured when the core barrel is at the bottom of the drill string and the ball valve is open. By using a pressure regulator, this pressure is maintained by increasing or decreasing the pressure as required through the pressure monitoring line. By this arrangement, the core is kept at in situ pressure even though the ball valve may leak slightly or the temperature change inside the chamber.

In addition, this line can be used to purge or flush the drilling fluid from the pressure chamber of the core barrel after the sample tube has been retracted and before the valve at the bottom of the chamber is closed. An inert gas, such as nitrogen, can be used for this purpose.

The operation of the core barrel of this invention has been described as it is used inside a drill string positioned in a well bore. Where the weight of the core barrel is sufficient to counteract the force required to force the sample tube into the formation being cored, then the core barrel can be used in an open hole. It can also be used under these circumstances to obtain samples at in situ pressure of the bottom sediments below a body of water without a well bore being drilled therein. Such samples could provide very important information concerning the bearing strength of the bottom, for example.

From the foregoing it will be seen that this invention is one well adapted to attain all of the ends and objects hereinabove set forth, together with other advantages which are obvious and which are inherent to the apparatus and method.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. Apparatus for obtaining a core at in situ pressure of the sedimentary deposits at the bottom of a well bore, a body of water or the like comprising a tubular housing adapted to be moved into position above the sedimentary deposits to be cored, a pressure chamber in the lower section of the housing, a sample tube located in the pressure chamber, valve means at the lower end of the pressure chamber to open and close the chamber to ambient conditions, means actuated from the surface for moving the sample tube through the open valve to force the sample tube into the sedimentary deposits to obtain a core of said deposits and to move the sample tube with the core back into the pressure chamber in the housing, means for closing the valve means to seal the pressure chamber from ambient conditions before the housing is removed from its position above the sedimentary deposits being cored to maintain substantially the in situ pressure of the core in the pressure chamber.

2. The apparatus of claim 1 further provided with means operable from the surface to purge the pressure chamber of ambient fluid after the sample tube has been moved back into the pressure chamber and before the valve means is closed.

3. The apparatus of claim 2 in which the valve means includes a ball valve member, a lower valve seat for engaging the ball valve member to seal the lower end of the pressure chamber when the valve member is in its closed position, an upper seat supported by the ball valve member, ball valve member loading means above the upper seat for exerting a downward force on the upper seat and the ball valve member, and means for moving the ball valve member loading means upwardly away from the upper seat before the ball valve member is rotated between its open and closed positions.

4. The apparatus of claim 3 in which the means for closing the ball valve member includes means for moving the valve member upwardly away from the lower seat and for rotating the valve member to its closed position while spaced from the lower seat.

5. The apparatus of claim 4 in which means are provided to limit the upward travel of the upper seat and the means for rotating the ball valve member exerts an upward eccentric force that combines with the upper seat to rotate the valve member.

6. Apparatus for recovering a core of the sedimentary deposits at the bottom of a well bore at its in situ pressure comprising a tubular housing adapted to be moved to the bottom of a well bore through a pipe string, a pressure chamber in the lower section of the housing, a sample tube located in the pressure chamber, valve means at the lower end of the pressure chamber to open and close the chamber to ambient conditions, means actuated from the surface for moving the sample tube through the open valve when the housing is located at the bottom of the pipe string to force the sample tube into the sedimentary deposits at the bottom of the well bore to obtain a core of said deposits and to move the sample tube with the core back into the pressure chamber in the housing, means for closing the valve means to seal the pressure chamber from ambient conditions before the housing is removed from its position at the lower end of the drill pipe to maintain the in situ pressure of the core in the pressure chamber while the core is being moved through the pipe string to the surface.

7. The apparatus of claim 6 further provided with means to hold the housing from upward movement relative to the pipe string as the sample tube is forced into the sedimentary deposits to obtain a core thereof.

8. The apparatus of claim 7 in which the valve means includes a ball valve member, a lower valve seat for engaging the ball valve member to seal the lower end of the pressure chamber when the valve member is in its closed position, an upper seat supported by the ball valve member, ball valve member loading means above the upper seat for exerting a downward force on the upper seat and the ball valve member, and means for moving the ball valve member loading means upwardly away from the upper seat before the ball valve member is rotated between its open and closed positions.

9. The apparatus of claim 8 in which the means for closing the ball valve member includes means for moving the valve member upwardly away from the lower seat and for rotating the valve member to its closed position while spaced from the lower seat.

10. The apparatus of claim 9 in which the means for moving the sample tube is connected to and supported by the means for moving the ball valve member loading means upwardly from the ball valve member to insure that the lower end of the sample tube is above the ball valve member when it is moved upwardly for rotation to its closed position.

11. The apparatus of claim 6 further provided with means operable from the surface for measuring the in situ pressure and means for regulating the pressure in the pressure chamber to maintain in situ pressure on the core until the core is removed from the pressure chamber.

12. The apparatus of claim 6 further provided with means for removing the sample tube and core from the pressure chamber while maintaining the core at in situ pressure including a transfer tube for connecting to the end of the housing below the pressure chamber, means for raising the pressure in the transfer tube to the pressure in the pressure chamber, means for gripping the end of the sample tube to disconnect the sample tube from the coring apparatus and to move the sample tube and core into the transfer tube, and valve means for closing the transfer tube to hold in situ pressure therein after the transfer tube is disconnected from the housing.

13. Apparatus for obtaining a core at in situ pressure of the sedimentary deposits at the bottom of a well bore or a body of water comprising a tubular housing adapted to be moved into position above the sedimentary deposits to be cored, a pressure chamber in the lower section of the housing, a sample tube located in the pressure chamber, valve means at the lower end of the pressure chamber to open and close the chamber to ambient conditions, said valve means including a valve member comprising a ball with hole through it and a lower valve seat positioned below the ball to engage the ball and seal the pressure chamber when the ball is in its closed position, means actuated from the surface for moving the sample tube through the open valve when the housing is located at the bottom of the pipe string to force the sample tube into the sedimentary deposits at the bottom of the well bore to obtain a core of said deposits and to move the sample tube with the core back into the pressure chamber in the housing, means for closing the valve means to seal the pressure chamber from ambient conditions before the housing is removed from its position at the lower end of the drill pipe to maintain the in situ pressure of the core in the pressure chamber while the core is being moved through the pipe string to the surface, said means including an upper seat of elastomeric material located above the ball, means limiting the upward movement of the upper seat away from the lower seat, and means for exerting an upward eccentric force on the ball to move the ball away from the lower seat into engagement with the upper seat to rotate the ball to its closed position.

14. The apparatus of claim 13 in which the upper seat rests on and is held against downward movement by the ball.

15. The apparatus of claim 14 further provided by ball loading means located above the upper seat to exert a downward force on the ball to urge it into sealing engagement with the lower seat and means to remove the downward force of the loading means while the ball is being moved from its open to its closed position.

16. A method of obtaining a core at in situ pressure from the sedimentary deposits at the bottom of a well bore, a body of water or the like comprising the steps of lowering a housing having a valve in the lower end thereof to a position above the sedimentary deposits, extending an open-ended sample tube from the housing through the open valve into the sedimentary deposits to force a core of the deposits into the sample tube, retracting the sample tube with the core therein into the housing above the valve, moving the valve element of the valve to its closed position, exerting a downward force on the valve element to hold the valve element in sealing engagement with the seat to seal the bottom of the housing below the sample tube to trap ambient pressure in the housing around the sample tube, and raising the housing to the surface.

17. A method of obtaining a core at in situ pressure from the sedimentary deposits at the bottom of a bore hole comprising the steps of positioning a pipe string in the well bore with an opening in its lower end, lowering a housing through the pipe string to a position adjacent the bottom of the well bore, extending an open-ended core tube from the housing into the sedimentary deposits at the bottom of the well bore to force a core of the deposits into the core tube, retracting the core tube with the core therein into the housing, purging the housing of ambient fluid, sealing the bottom of the housing below the core tube to trap in situ pressure in the housing around the core tube, and raising the housing to the surface.

18. A method of obtaining a core at in situ pressure from the sedimentary deposits at the bottom of a bore hole comprising the steps of positioning a pipe string in the well bore with an opening in its lower end, lowering a housing having a ball valve in the lower end thereof through the pipe string to a position adjacent the bottom of the well bore, extending an open-ended core tube from the housing through the ball valve into the sedimentary deposits at the bottom of the well bore to force a core of the deposits into the sample tube, retracting the core tube with the core therein into the housing above the ball valve, purging the housing of ambient fluid, raising the ball of the ball valve from its seat, rotating the ball to its closed position, lowering the ball into engagement with the seat, exerting a downward force on the ball to hold the ball in sealing engagement with the seat to seal the bottom of the housing below the core tube to trap in situ pressure in the housing around the core tube, raising the housing to the surface, and transferring the core tube from the housing to a transfer tube while maintaining the core at in situ pressure.

19. The method of claim 18 in which the transferring of the core includes connecting a transfer tube to the end of the housing, raising the pressure of the transfer tube to the pressure of the housing, opening the housing to the transfer tube, moving the end of the core tube into the transfer tube, disconnecting the core tube from the housing, moving the core tube into the transfer tube, sealing the transfer tube to hold in situ pressure on the core, and disconnecting the transfer chamber from the housing.

* * * * *